United States Patent [19]

Mueller, Jr. et al.

[11] Patent Number: 4,811,865

[45] Date of Patent: Mar. 14, 1989

[54] CAP AND SPOUT ASSEMBLY FOR A CAN

[75] Inventors: Raymond Mueller, Jr., Hilbert; Richard Nelson, Fox Point, both of Wis.

[73] Assignee: Western Industries Inc., Milwaukee, Wis.

[21] Appl. No.: 100,546

[22] Filed: Sep. 24, 1987

[51] Int. Cl.[4] ..... B67B 5/06

[52] U.S. Cl. ..... 222/153; 222/539; 222/543; 215/246; 215/250

[58] Field of Search ..... 222/153, 539, 538, 543; 215/203, 250, 246, 252, 216–217; 292/318–320

[56] References Cited

U.S. PATENT DOCUMENTS

| | | | |
|---|---|---|---|
| 1,326,853 | 12/1919 | Davis | 222/153 X |
| 2,070,783 | 2/1937 | Conner | 222/539 |
| 3,134,522 | 5/1964 | Shwisha | 222/539 |
| 3,250,434 | 5/1966 | Howlett | 222/539 X |
| 4,537,432 | 8/1985 | Meeks | 292/318 |

FOREIGN PATENT DOCUMENTS

| | | | |
|---|---|---|---|
| 15935 | of 1899 | United Kingdom | 215/250 |
| 881529 | 11/1961 | United Kingdom | 222/539 |
| 2088345 | 6/1982 | United Kingdom | 215/216 |

*Primary Examiner*—Charles A. Marmor

*Attorney, Agent, or Firm*—Andrus, Sceales, Starke & Sawall

[57] ABSTRACT

An improved cap and spout assembly for a can adapted to contain a liquid, such as gasoline. The assembly includes the cap having internal threads to be threaded on an upstanding flange bordering an opening in the can, and the cap includes an outer transverse surface having a central opening. A spout is removably attachable to the cap and the inner end of the spout is provided with a flange to engage the inner face of the transverse surface of the cap. In the retail market place, the spout is inverted for storage and extends inwardly of the can. A flexible strap is integrally molded with the cap and in inserted through an opening on the can and engaged with a locking mechanism on the cap to prevent removal and theft of the cap and spout from the can. At the time of use, the spout is reversed in position so that it extends outwardly from the cap and the outer end of the spout defines an outlet which is enclosed by a removable cover. The cover is connected to the spout by an integrally molded flexible tether which is constructed so that when the cover is removed from the outlet, the resiliency of the tether will move the cover to a non-obstructing position where it will not interfere with pouring of liquid from the outlet of the spout.

5 Claims, 2 Drawing Sheets

CAP AND SPOUT ASSEMBLY FOR A CAN

BACKGROUND OF THE INVENTION

Cans, such as those used for storing gasoline or other liquids, generally include a cap and spout assembly which aids in pouring the liquid from the can. In the conventional cap and spout assembly, the annular cap is threaded onto the externally threaded flange bordering an opening in the can, and the inner end of the spout is formed with a laterally extending flange which engages the annular edge of the cap.

In the retail market, the spout is inverted with respect to the cap and extends inwardly of the can to save storage space. It has been found that occasionally, the cap and spout assembly will be removed from the can at the retail store which renders the can unsaleable. Thus, there has been need for a pilfer-proof cap which would prevent theft of the cap and spout assembly at the retail level.

The conventional cap and spout assembly has primary use on gasoline cans for filling tanks on lawn mowers, snow throwers, tillers and other equipment, and in certain cases, the assembly may be employed to fill an automobile gas tank. In some instances, the tank is constructed so that the fill opening is in a rather inaccessible location, and this is particularly true of automobiles which require unleaded gasoline, with the result that the conventional spout will not adequately pour the liquid into the tank without some spillage.

It has been proposed to include a removable cover for the outlet on the spout in order to prevent spillage of the gasoline or liquid from the can as the liquid sloshes in the can during transporting. To prevent loss of the cover, the covers as used in the past have been attached through a tether to the spout. However, the connection of the cover to the spout has been such that the cover, when removed from the outlet of the spout, is not completely removed from the pouring area so that it tends to interfere with the pouring of liquid from the spout.

SUMMARY OF THE INVENTION

The invention is directed to an improved cap and spout assembly for a liquid can or container, such as a gasoline container. In accordance with the invention, the assembly includes an internally threaded annular cap to be threaded to a flange bordering an opening in the container.

A spout, preferably molded from plastic material, is removably attached to the cap and the inner end of the spout has a lateral flange which is adapted to engage the annular edge of the cap to seal the joint between the spout and cap.

At the retail level, the spout is inverted so that it extends inwardly of the container. To prevent removal and theft of the cap and spout assembly from the container, a flexible strap, preferably integrally molded with the cap is inserted through a handle or other opening in the container and is locked to the cap. The locking mechanism may take the form of a series of teeth or barbs on the free end of the strap which project through an opening in the cap and are engaged with an abutment on the cap. With this locking arrangement, the strap can be freely inserted through the opening to provide the locking relationship but cannot be moved in the opposite direction without severing the strap.

At the time of use, the strap is severed by the user and the spout is reversed in position with respect to the cap so that it extends outwardly from the container.

As a feature of the invention, the outer end of the spout, which defines an outlet, can be enclosed by a removable cover which is connected to the spout through an integrally molded strap or tether. The tether is constructed so the resiliency of the tether will automatically move the cover to a location removed from the outlet when the cover is disengaged from the outlet in the spout. With the cover in an unobstructing position, the liquid can be poured from the outlet without interference with the cover or tether.

The invention provides a pilfer-proof cap and spout assembly which prevents theft of the assembly at the retail level. The locking strap is self-locking and tamper-proof to prevent removal of the cap until the locking strap is severed at the time of use.

The cap and spout assembly can be readily attached to the can and can be used with a wide variety of cans of different shapes and configurations.

The spout is configured to facilitate pouring of the liquid or gasoline into a tank and has particular advantage in pouring gasoline into the tank of an automobile having a small inlet opening for unleaded fuel.

The spout is normally enclosed by a removable cover which is integrally connected to the spout through a flexible strap tether. The tether is constructed to move the cover to a non-interfering location when the cover is removed.

Other objects and advantages will appear in the course of the following description.

DESCRIPTION OF THE DRAWINGS

The drawings illustrate the best mode presently contemplated of carrying out the invention.

In the drawings.

DESCRIPTION OF THE ILLUSTRATED EMBODIMENT

Figure 1:
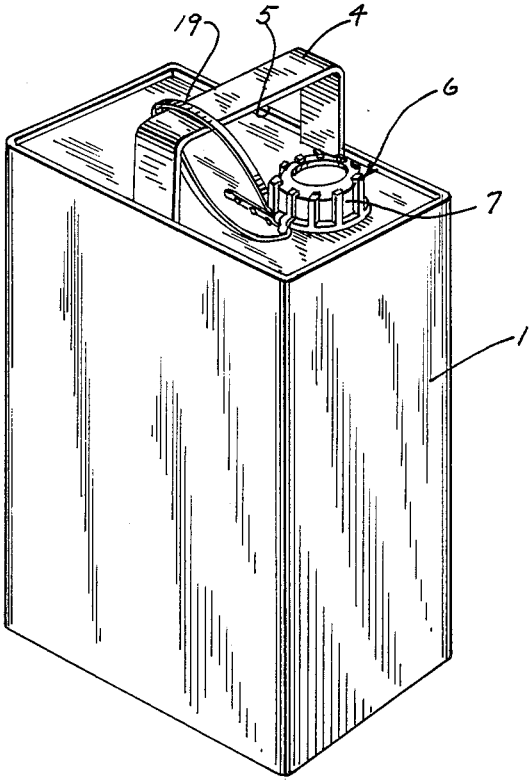
FIG. 1 is a perspective view of a container incorporating the cap and spout assembly of the invention with the spout being shown in the inwardly extending storage position and the cap locked to the container.

The invention is directed to an improved cap and spout assembly for use with a can or container 1 to contain a liquid such as gasoline. The container can be fabricated from metal or plastic material.

The upper end of container 1 is provided with an upstanding threaded flange 2 which borders an outlet 3. Container 1 is provided with a generally U-shaped handle 4 located adjacent outlet 3, and the U-shaped handle defines a hand grip or opening 5 for lifting the container.

Figure 4:
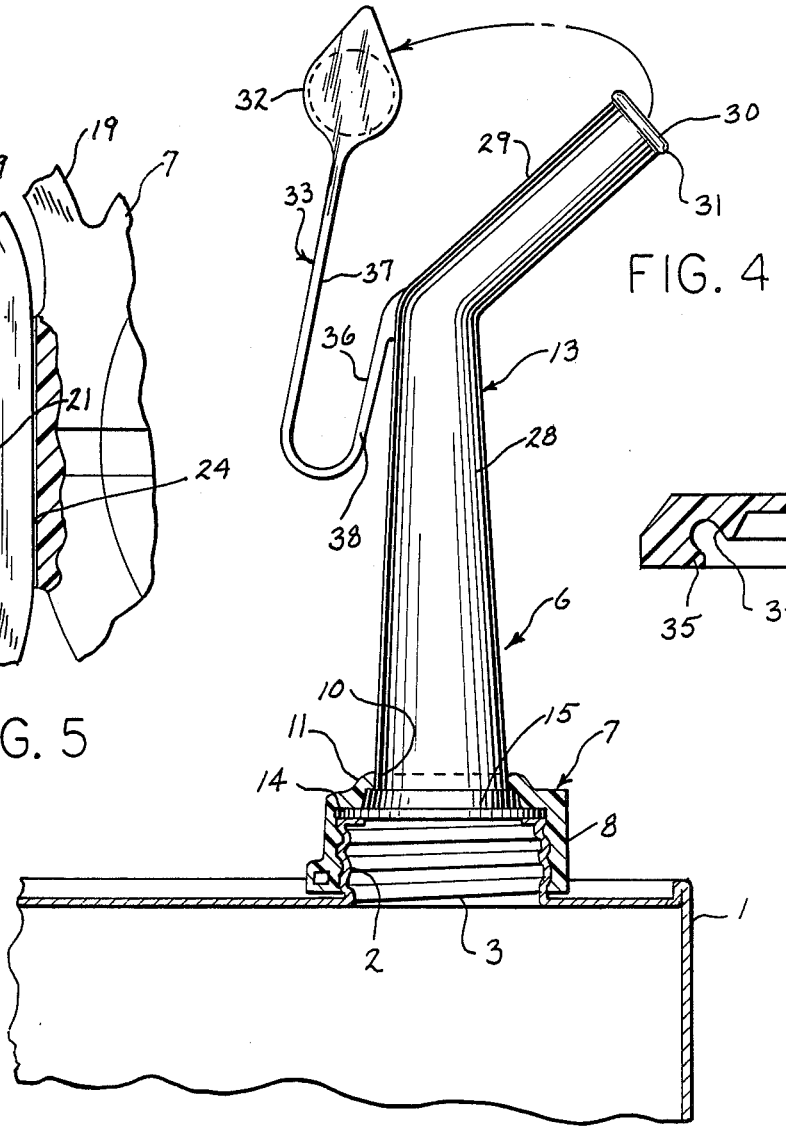
FIG. 4 is a vertical section similar to FIG. 2 showing the spout in the outer pouring position.

The cap and spout assembly 6 of the invention includes a cap 7, preferably molded from a plastic material such as polyethylene, and the cap is composed of a generally cylindrical threaded section 8 which is engaged with the threaded flange 2 of can 1. The outer end of the cylindrical section 8 is enclosed by a transverse surface or head 9 having a central opening 10. As best shown in FIG. 4, an upwardly inclined annular lip 11 borders opening 10. The outer surface of the cap can be formed with a series of spaced longitudinal ribs 12.

Cap and spout assembly 6 also includes a tubular spout 13, preferably molded from a plastic material such as polyethylene. One end of spout 13 is formed with a laterally extending flange 14 and, as shown in FIG. 4, a sloping annular surface 15 is located adjacent flange 14. When the spout 13 is in its operating position, as shown in FIG. 4, sloping surface 15 will be wedged against the flexible lip 11 on cap 7 to provide an effective seal so that no washer or gasket is required to seal the joint between the cap and the spout.

The inner end of spout 13 is also provided with an internal groove 16 and a plastic ring 17 is press-fitted within groove 16 and carries a screen 18 which extends across the inner end of the spout. Screen 18 serves to filter contaminants from the liquid as the liquid is poured from the spout.

Figure 2:
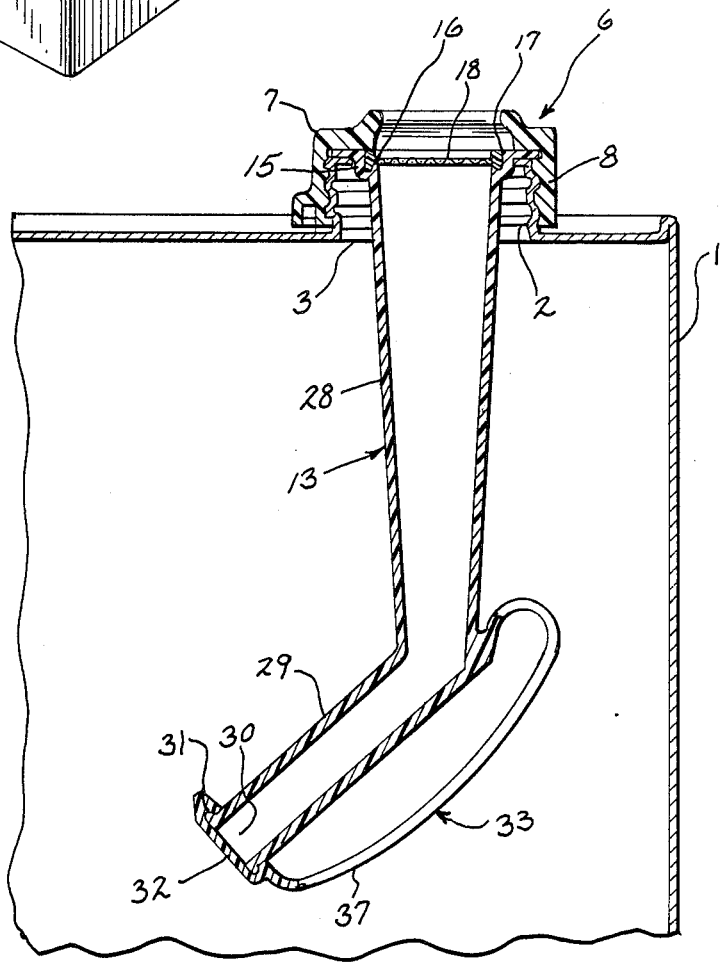
FIG. 2 is an enlarged fragmentary vertical section showing the cap and spout attached to the container with the spout in the storage position.
Figure 3:
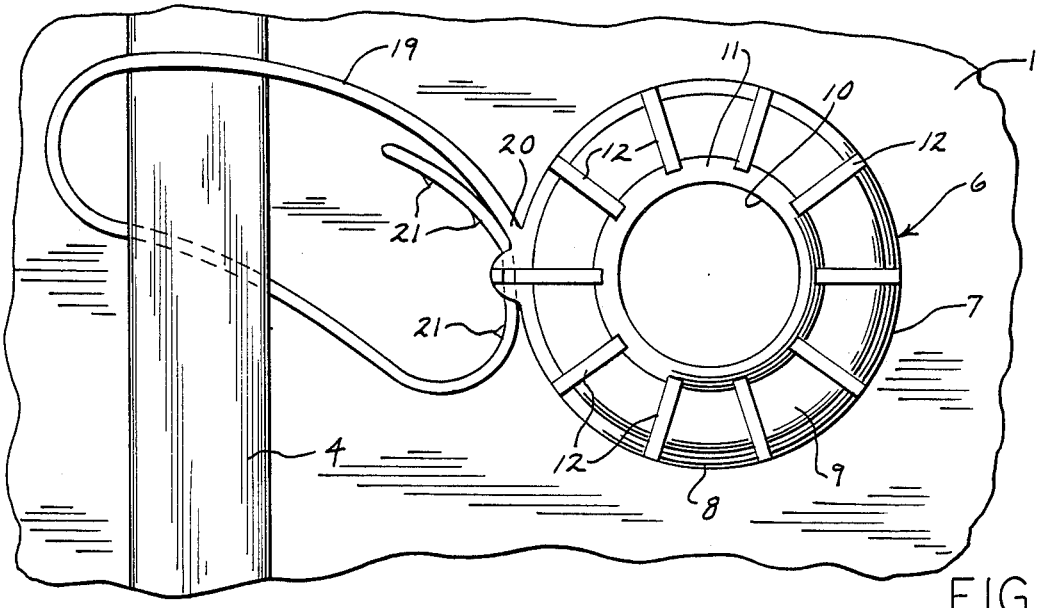
FIG. 3 is an enlarged fragmentary plan view showing the assembly as connected to the container.

In the retail market, spout 13 is normally stored in an inverted condition in which the spout extends inwardly of the container 1, as shown in FIG. 2. In this condition, threading down of the cap will secure the flange 14 between the inner face of surface 9 and the outer end of flange 2 on container 1.

Figure 5:
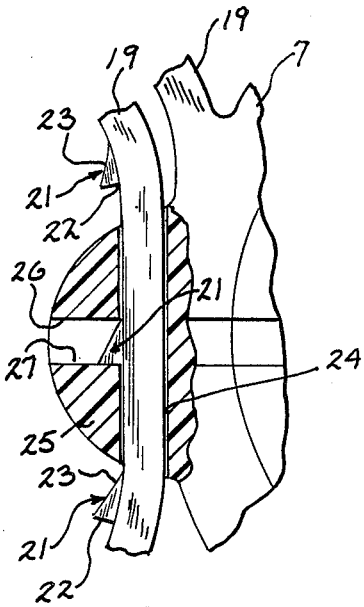
FIG. 5 is an enlarged fragmentary plan view with parts broken away and showing the locking strap.

To prevent theft of the cap and spout assembly 6 at the retail level, a flexible locking strap 19 is integrally molded with cap 7. As shown in FIG. 5 one end 20 of strap 19 is connected to the side surface of cap 7 and the strap is provided with a series of laterally extending, spaced teeth or barbs 21. As shown in FIG. 5, each tooth 21 is provided with a shoulder 22 which extends laterally from the strap and a tapered surface 23 which connects the shoulder 22 to the strap.

The free end of strap 19, after passing through opening 5 in handle 4, is adapted to be inserted through a passage 24 formed in a projection 25 on cap 7. Projection 25 is provided with a radially extending slot 26 which defines a ledge or abutment 27.

As the free end of strap 19 is inserted through opening 24, the tapered surface 23 of each tooth 21 will ride against the wall bordering passage 24, deflecting the tooth to permit the tooth to pass beyond the abutment 27. However, the shoulder 22 on the tooth will engage the abutment 27 to prevent the strap from being removed from the opening. Thus, the teeth 21 and abutment 27 provide an effective one-way locking mechanism which enables the strap 19 to be inserted within the opening 24 but prevents removal of the strap.

As best shown in FIG. 1, the free end of strap 19 is inserted through the opening 5 in handle 4 of the container 1 before it is inserted into the opening 24 in the cap. With the strap 19 locked to the cap, the strap will effectively lock the cap to the container or can 1 to prevent theft. At the time of use, the consumer or purchaser will cut or otherwise sever strap 19 to permit the cap to be removed from container 1. The spout 13 will then be reversed in position so that the spout extends outwardly of the container 1, as illustrated in FIG. 4.

Spout 13 includes an inner section 28 and an outer section 29 which extends at an acute angle of about 35° to 45° with respect to the inner section 28, and preferably about 40°. The outer end of outer section 29 defines an outlet 30 which is bordered by an outwardly extending lip 31.

Outlet 30 is adapted to be closed off by a cover 32 which is connected to spout 13 through an integrally molded strap or tether 33.

Figure 6:
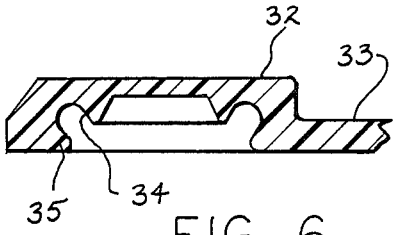
FIG. 6 is a sectional view of the cover for the spout.

As best shown in FIG. 6, the inner surface of cover 32 is provided with an annular recess 34 bordered on its inner edge by an annular ridge 35. With this construction, the lip 31 on outlet 30 can be press fitted into the recess 34 to securely hold the cover 32 on outlet 30.

With cover 32 removed from the spout outlet, tether 33 has a relaxed configuration, including a first portion 36 which is integrally connected to the spout adjacent the junction between inner section 28 and outer section 29. In addition, tether 33 includes a second portion 37 which is connected to the first portion 36 by a reverse bend 38. With the cover 32 removed from outlet 30, the configuration of tether 33 along with the resilient nature of the plastic material, will position portion 36 alongside inner section 28, at an angle of about 10° to 20° with respect to the axis of section 28, and will position portion 37 generally parallel to portion 36, as shown in FIG. 5. With this location of portion 37, the attached cover 32 will be a substantial distance away from outlet 30 so that it will not interfere with the pouring of liquid or gasoline from outlet 30.

At the retail level, the locking strap 19 will securely lock the cap to the container 1 to prevent theft of the cap and spout. By varying the length of the locking strap 19, the cap and spout assembly 6 can be used with a wide variety of cans of different configurations.

The locking strap 19 is self-locking, with the locking elements being integrally molded with the cap so that no auxiliary locking elements or fasteners are required. In addition, the locking mechanism is tamper-proof and cannot be opened except by severing the strap.

The outlet cover 32 is integrally connected to the spout through a flexible strap or tether 33 which is constructed to move the cover to a noninterfering location when the cover is removed from the outlet.

Various modes of carrying out the invention are contemplated as being within the scope of the following claims particularly pointing out and distinctly claiming the subject matter which is regarded as the invention.

I claim:

1. A combination cap and spout assembly for a container, comprising an annular cap to be engaged with an outlet in the container and having a central opening, a spout removably connected to the cap and having a flange to engage an annular edge bordering the central opening in the cap, a flexible elongated strap having one end connected to the cap and having a distal end, said cap having a passage separate from said opening, a pair of oppositely facing abutments disposed on said cap and bordering said passage, each abutment being disposed generally normal to the axis of said passage, and a plurality of barbs spaced along the length of said strap, each barb having a sloping surface facing the distal end of the strap and a shoulder facing the first end of the strap, each shoulder being disposed generally normal to the longitudinal dimensions of said strap, said strap being constructed and arranged to be inserted through an aperture on the container and then inserted into either end of said passage to cause a shoulder of a barb to engage a respective abutment to lock the strap to the cap.

2. The combination of claim 1, wherein said cap is formed with a recess communicating with said passage, said recess being bordered by a pair of generally parallel walls defining said abutments.

3. The combination of claim 1, wherein said passage extends generally circumferentially of said cap.

4. The combination of claim 1, wherein said first end of the strap extends generally tangentially to the periphery of the cap.

5. A combination cap and spout assembly for a container, comprising an annular cap having internal threads to be engaged with a threaded outlet in the container and having a central opening, a spout removably connected to the cap and having a flange to engage an annular edge bordering the central opening in said cap, a flexible elongated strap having a first end connected to the cap and extending generally tangentially to the periphery of the cap and said strap having a distal end, said cap having a passage located adjacent the connection of said first end of the strap to said cap, said passage extending generally circumferentially of the cap, an abutment bordering the passage and extending generally normal to the axis of the passage, and a plurality of barbs spaced along the length of said strap, each barb having a sloping surface toward the distal end of the strap and having a shoulder facing said first end of the strap and disposed generally normal to the longitudinal dimension of the strap, said strap being disposed to be inserted through an aperture on the container and then inserted through said passage with said shoulder disposed to engage said abutment to lock the strap to the cap.

* * * * *